United States Patent [19]

Cluff

[11] Patent Number: 4,723,761

[45] Date of Patent: Feb. 9, 1988

[54] CHAIN LINK FENCING CONTAINING DECORATIVE SLATS

[76] Inventor: Robert G. Cluff, 4983, Taylorsville, Utah 84118

[21] Appl. No.: 866,720

[22] Filed: May 27, 1986

[51] Int. Cl.[4] ..... B21F 27/00

[52] U.S. Cl. ..... 256/34; 256/32

[58] Field of Search ..... 256/34, 35, 32, 22; 245/11

[56] References Cited

U.S. PATENT DOCUMENTS

| | | | |
|---|---|---|---|
| 850,002 | 4/1907 | Houchin | 245/11 |
| 2,760,759 | 8/1956 | Rice | 256/34 |
| 2,802,645 | 8/1957 | Rice | 256/34 |
| 3,572,640 | 3/1971 | Veechiarelli | 256/34 |
| 3,913,889 | 10/1975 | Nugent et al. | 256/34 X |
| 3,958,794 | 5/1976 | Suprunuk et al. | 256/34 |
| 4,085,954 | 4/1978 | Thompson | 256/34 |
| 4,512,556 | 4/1985 | Meglino | 256/34 |

*Primary Examiner*—Andrew V. Kundrat

*Attorney, Agent, or Firm*—Thorpe, North & Western

[57] ABSTRACT

A means for retaining slats woven flatwise through the links of a chain link fence is provided with a receptacle formed in each of the slats and a generally U-shaped clip member having legs engaging respective receptacles in adjacent slats.

8 Claims, 9 Drawing Figures

CHAIN LINK FENCING CONTAINING DECORATIVE SLATS

BACKGROUND OF THE INVENTION

1. Field

This invention relates to chain link fences which have a plurality of decorative, elongate slats woven through the links of the chain link fabric of the fence. More particularly, the present invention relates to improved slats comprising means for locking the slats together and retaining the slats in a uniform position along the fencing. Further, the present invention relates to improved slats which are adjustable and expandable in their transverse direction such that the slats can be used to provide improved privacy with any of the various sized chain link fencing.

2. State of the Art

It is well known to insert slats in chain link fences to provide privacy and to improve the appearance of the fence. Unfortunately, there are two rather serious problems encountered in using slats in chain link fencing, first, the slats have a tendency to shift longitudinally after being inserted in the wire fabric of the chain link fence so as to become disarranged and uneven. Disarranged, uneven slats greatly impair the appearance of the fence. The second problem is created because the chain link fabric which is commercially available is woven with chain links of different sizes. Thus, spaces between links through which the slats are fitted have different widths. Heretofore, the slats have been made of in a width which will fit in the chain link fabric made the smallest links. When used in fabric made from larger links, the slat is undersized and does not provide maximum privacy.

Several methods have been proposed to alleviate the first problem, i.e., for securing or attaching the slats in their desired position in the wire fabric of the chain link fence. The slats have been secured to the chain links in the fence by using staples, nails and other fasteners. In addition systems have been proposed for interlocking the slats with channel members or elongate rigid connecting members which run along the length of the fence and which engage the slat members. The installation of such systems is a tedious, time consuming, costly operation. Representative U.S. patents which have been directed to retaining slats in position in chain link fences are:

| | | |
|---|---|---|
| 2,760,759 | 3,037,593 | 4,085,954 |
| 2,802,645 | 3,069,142 | 4,512,556 |

The second problem has defied a simple resolution. Various widths of slats can be used; however, that involves large inventories of the various sized slats. As mentioned previously, the general practice was to provide only one size slat. That size slat was adapted to fit in the spaces formed by the smallest links of chain fabric. When used in chain fabric made from larger links, the slats were undersized and left an open space between the slats which reduced the privacy provided by the slats.

3. Objectives

A principal objective of the present invention is to provide new and improved slats comprising novel, unique means for retaining the slats at a uniform position along the fencing. A further objective of the invention is to provide new and improved slats which comprise novel and unique means for adjusting the width of the slats and for interconnecting adjacent slats along their longitudinal sides when installed in the fabric of a chain link fence. A still further object of the invention is to provide inexpensive slats which can be used in stacked pairs such that different colors are visible from the two sides of the fence.

SUMMARY OF THE INVENTION

The above objectives are achieved in accordance with the present invention by providing a chain link fence of the type including a plurality of elongate slats woven flatwise through the links of the chain link fabric of the fence in spaced, parallel arrangement. The novel slats, in accordance with this invention, are formed integrally from an elongate, generally narrow sheet whose width dimension is adjustable or expandable. The adjustment or expansion feature is provided by at least one accordion fold being formed lengthwise along the length of the slat intermediate the side edges of the slat, so that essentially flat side edge portions of the sheet from which the slat is formed extend from the opposite side edges of the accordion fold portion of the slat.

A plurality of openings or apertures are spaced along each of the flat side edge portions of the slats such that when the slats are woven through the links of the chain link fabric of the fence, the openings in mutually adjacent side edges of the slats would be aligned. Connector members having a broad, block "U" shape in general are provided. The legs of the connector members are adapted to be received in locking engagement with aligned sets of openings or apertures in adjacent side edges of the slats. The connector members are also adapted to fit over the wire links between the adjacent slats and thus retain the slats in a uniform position along the length of the fencing.

The slats could conveniently be used in various sizes of chain link fabric being used in conventional chain link fencing. The unexpanded width of the slats would be small enough to fit between the smallest links of commercially available chain link fencing when the slats were to be used in fencing having larger links, each slat is expanded by expanding the accordion fold. The expanded slat then fills the available space in the links of the fencing so as to provide maximum privacy. The expanded slats are held in their expanded condition by the connector members which pull adjacent slats together to maintain the slats in their maximum expanded condition as allowed by the size of the links in the chain link fencing.

The slats of the present invention are also advantageously made such that one slat can be superimposed in stacking relationship over another slat. This allows slats made of two different colors to be used, as will be further described hereinafter, such that slats of one color face one way from the fencing, and slats of the other color face in the other direction. Thus, two adjoining property owners could utilize the slats in a common fence so that each property owner could select a color of the slats facing his property which is different than the color of the slats facing the adjoining property.

Additional objects and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which.

DETAILED DESCRIPTION OF THE PREFERRED EMBODIMENTS

Figure 1:
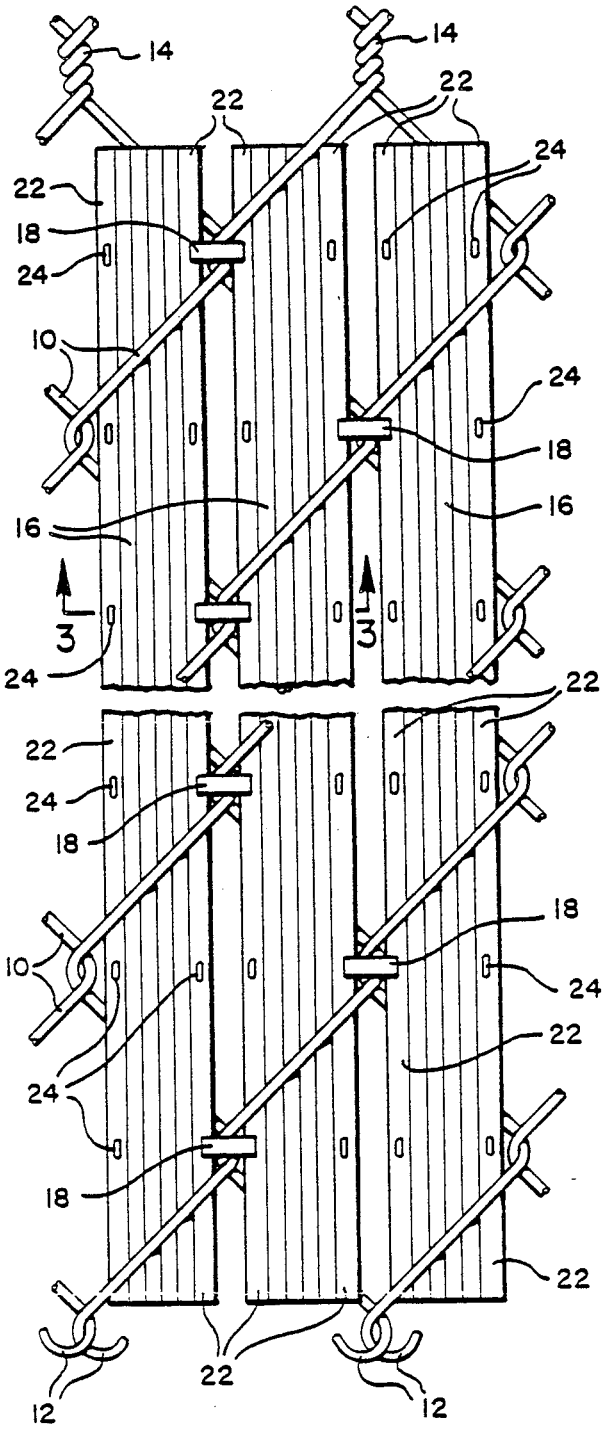
FIG. 1 is a fragmentary view in elevation of a portion of chain link fencing incorporating the novel slats and retaining system of the present invention.
Figure 2:
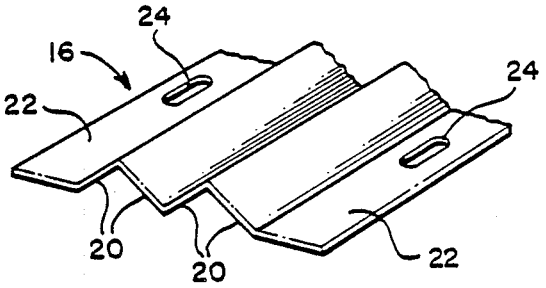
FIG. 2 is a fragmentary end pictorial view of a slat in accordance with the invention.

Two preferred embodiments of the slat retaining system of the present invention are shown in the drawings and will be described hereinafter. Like parts in the various figures of the drawings will be identified with the same reference numbers.

The present invention involves an improvement in conventional chain link fencing in which elongate wires are bent in zig-zag manner and interlocked one with another to form a chain link fabric comprising a plurality of links 10. The bottom ends of adjacent wires of the chain link fabric may be interconnected by reversely bent end portions 12, and the upper ends of adjacent wires are interconnected by twisting the upper portions together. The twisted upper portions 14 present rather sharp barbs which discourage attempts to climb over the fence. It is the preference of some, however, to invert the chain link fabric so as to place the twisted end portions 14 at the bottom.

A plurality of elongate slats 16 are provided, with the slats 16 being woven flatwise through the links 10 of the chain link fabric. The slats 16 are disposed in spaced, parallel relationship. In the illustrated embodiments, the slats 16 are woven through the chain links 10 so as to extend vertically relative to the fence. The slats 16 may be made of plastic or metal. In accordance with this invention, novel improved slats 16 are provided together with novel means for retaining the slats 16 in uniform positions along the fencing. The novel improved slats 16 comprise narrow, elongate sheets which include means for varying or adjusting the width of the slats 16. By providing simple means for expansion of the slats 16 in their transverse direction or width, the slats 16 are adapted to be used with chain link fabric in which the chain links 10 are of different sizes. The slats 16 in their unexpanded condition are adapted to be woven within the chain links 10 made of the smallest links 10 which are commercially available. When used with chain link fabric having larger links 10, the slats are expanded in their transverse direction or width such that the slat essentially fills the space formed by the links 10 of the chain link fabric. Thus, the single sized slats 16 of the present invention can be used with all sizes of commercially available chain link fabric to provide maximum privacy from any of the chain link fabrics.

In addition, an improvement is provided in the means for retaining the slats 16 at uniform positions and for securely locking the slats 16 in the chain link fabric so as to prevent the slats 16 from being removed from the fencing by vandals. The improved means for retaining the slats 16 in position in the fencing comprises novel clips 18 which are adapted to engage adjacent slats 16 and simultaneously lock the slats to the chain link fabric. The novel clips 18 will be more fully described hereinafter.

Preferred embodiments of the expansible slats 16 of the invention are shown in the drawings. The slats 16 are formed from an elongate sheet of material. The material can be sheet metal or extruded plastic sheet. An expansion section is built into the slat 16 such that the slat 16 can be expanded in its transverse dimension, i.e., its width. As shown in FIGS. 1–3 and 5, at least one accordion fold 20 is formed along the length of each slat 16, with the accordion fold 20 being located intermediate and parallel with the opposite side edges of the slat 16. In the embodiment in FIGS. 1–3 and 5, two accordion folds 20 are formed side-by-side and are located along the longitudinal central portion of the slat 16.

When the slats 16 are formed from thin metal sheets, the accordion folds 20 are formed by simply bending the metal sheets to form the folds 20. When the slats 16 are formed from extruded plastic material, the folds 20 are formed integrally in the slat 16 as it is being extruded. To improve the hinge-like of the folds 20 when the slats 16 are made of plastics, undercut grooves 36 (FIG. 3) are preferably formed along the length of each fold. The grooves 36 form reduced thickness of the plastic at the hinge point of the fold 20 and enhance the ease in which the fold 20 can be expanded and contracted.

As illustrated, the slats 16 preferably have a pair of essentially flat side edge portions 22 which flank the accordion fold portion 20 and extend from the opposite side edges of the accordion fold portion 20. The flat side edge portions 22 generally extend in a common plane through the width of the slat 16. By being formed uniformly, the slats 16 are capable of being stacked upon each other in superimposed position. This allows compact storage or shipping of the slats 16, and as will be described hereinafter with respect to FIG. 5, the stacking feature allows pairs of slats 16 to be used in superimposed positions in the chain link fencing to produce different decorative effects on the opposite sides of the fencing.

Figure 6:
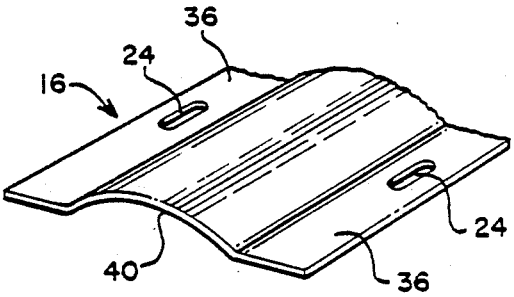
FIG. 6 is a fragmentary end pictorial view of another embodiment of a slat in accordance with the invention.

Another preferred embodiment of slats which can be expanded and contracted is shown in FIG. 6. Instead of having an accordian fold running the length of the slats 16, the slat 16 has a shape of a curve or arch. As shown, the end view or a cross section of the slat shows the flat side edge portions 36 joined by an expansive portion having the cross sectional shape of an arch 40. The arch section 40 can flex to either expand the width of the slat 16 or contract to decrease the width of the slat 16.

Figure 4:
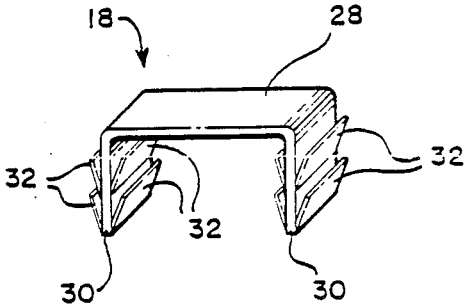
FIG. 4 is a pictorial view of one embodiment of the connector means of the present invention.

The slats 16 are retained in a uniform position in the chain link fabric by the use of novel clips 18 in combination with apertures or openings 24 in the flat side edges 22 of the slats 16. A preferred embodiment of the clip 18 is shown in FIG. 4. The clip 18 has a broad, block "U" shape, with the base 28 of the clip 18 being substantially planar as shown. Alternatively, the base 28 of the clip 18 could be slightly curved. The alternative embodiment comprising such a curved base 28 is not illustrated. The legs 30 of the U-shaped clip 18 have at least one set of barbs 32 for each leg. As illustrated, each leg 30 has a pair of spaced barbs 32.

The clips 18 are used in combination with the openings 24 in the side edges of the slats 16. The legs of the clips 18 are adapted to be received in locking engagement with aligned sets of openings 24 in adjacently positioned side edges 36 of adjacent slats 16. The openings 24 are shaped to correspond to the shape of the legs 30. In the preferred, illustrated embodiment, the clips 18 are made from extruded, channel members, such that the base 28 and legs 30 are generally rectangular in shape. The corresponding openings 24 in the side edges 36 must be relative narrow elongate openings as shown so as to accept the rectangular legs 30 of the clips 18.

The extruded clip members 18 can be made of aluminum or other extrudable metal. Advantageously, the clips 18 are made of a plastic material. The material is extruded in a continuous length, and the clips 18 are cut from the extruded member. The barbs 32 are formed integrally in the legs 30 of the clips 18 as the extruded member from which the clips 18 are cut is being extruded. The barbs 32 are shaped like an arrow head, such that the barbs 32 will pass through the opening 24 and then expand to lock the clips 18 in position in the openings 24.

Figure 3:
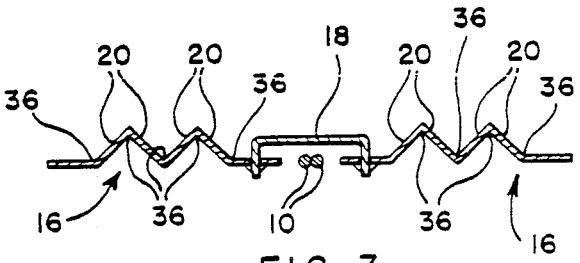
FIG. 3 is a cross section taken along line 3—3 showing the novel connection between the slats.

As illustrated in FIGS. 1 and 3, the slats are woven in the fence fabric in single side-by-side arrangement, and the clips 18 are used to connect adjacent slots 16. In such arrangement, the legs 30 of the clips 18 need have only one barb 32 per leg 30. This barb 32 securely attaches the clip 32 to the respective slat 16. A plurality of openings 24 are spaced along the slats 16 such that the openings 24 in one slat 16 can be aligned with corresponding openings in the next adjacent slat 16 to form the pairs of openings which can be used for insertion of the clip members 18.

The slats 16 are preferably positioned so that at least some of the sets of openings 24 in the slats are positioned near the engagement of the wire links 10 in the chain link fabric. The clips 18 are then positioned in at least one or two such sets of openings 24 on each side of each slat 16 to lock that slat 16 and the adjacent slat 16 in a uniform position in the chain link fabric. As locked into the chain link fabric, the slats 16 can not move longitudinally one way or another, and they, thus, remain in a uniform position. Because the slats 16 are locked into position, they resist being removed by vandals.

As the slats are being locked into place along the fence fabric, they are also expanded so as to fill in the maximum space between links in the fencing and thus provide maximum privacy. The expansion of the slats 16 is achieved by the successive securing of the slats 16 together with the clips 18. Each slat 16 is forced to expand about the accordian folds or other expansion means therein so that the slat 16 can be connected to the adjacent slats 16 on each side thereof. Each slat 16 is thus held in its maximum expansion allowed by the links in the chain link fabric. The slats 16 are sized such that the unexpanded slats 16 will fit within the smallest of the links of commercially available chain link fabric. The slats 16 need not be expanded when used with the chain link fabric having the small links. When the slats 16 are used with chain link fabric having larger links, the slats 16 are expanded so as to effectively fill the space between the links. Thus, in accordance with the invention, one size of slats 16 can be used with all sizes of chain link fabric to achieve maximum privacy with each and all sizes of the chain link fabric.

When a common chain link fence is erected between adjoining land owners, it will commonly occur that one property owner would prefer a different color slat facing his property than the color selected by the adjoining property owner. The problem is easily alleviated with the slats 16 of the present invention.

Figure 5:
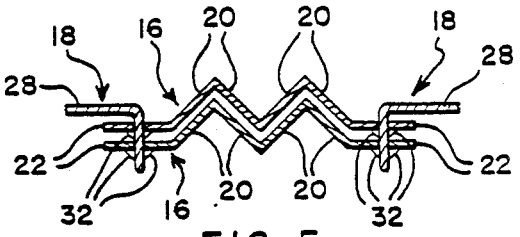
FIG. 5 is a cross section through a pair of superimposed, stacked slats showing how the slats can be used to produce one color effect on one side of the fence and another color effect on the second side of the fence.

As shown in FIG. 5, the slats 16 are adapted to be stacked one on top of the other, whether in the unexpanded or expanded condition. Thus, in a common fence between adjacent property owners, the slats 16 can be installed in stacked pairs such that one color faces from one side of the fence and another color faces from the other side. In installing the stacked slats 16 as shown in FIG. 5, it is advantageous to use clips 18 which have two barbs 32 on each leg 30 thereof. The first slats, which will face the first side of the fence, are installed just as previously described. The clips 18 will be inserted into the openings in the side edges 36 of the slats 16 such that the second barbs 32, the barb closest to the base 28 of the clips 18, engage the openings in the slats. The second slats 16 are installed in superimposed, stacked relationship with the slats 16 in the first group. The openings in the slats 16 engage the existing clips 18 such that the second barbs 32, the barbs furthest to the base 28 of the clips 18, engage the openings in the stacked, second slats 16. When installed, the first group of slats 16 face from one side of the fence and the slats 16 in the stacked or second group face from the other side of the fence. Thus, the property owners on each side of the fence can select the color of the slats which face their particular property.

Figure 7:
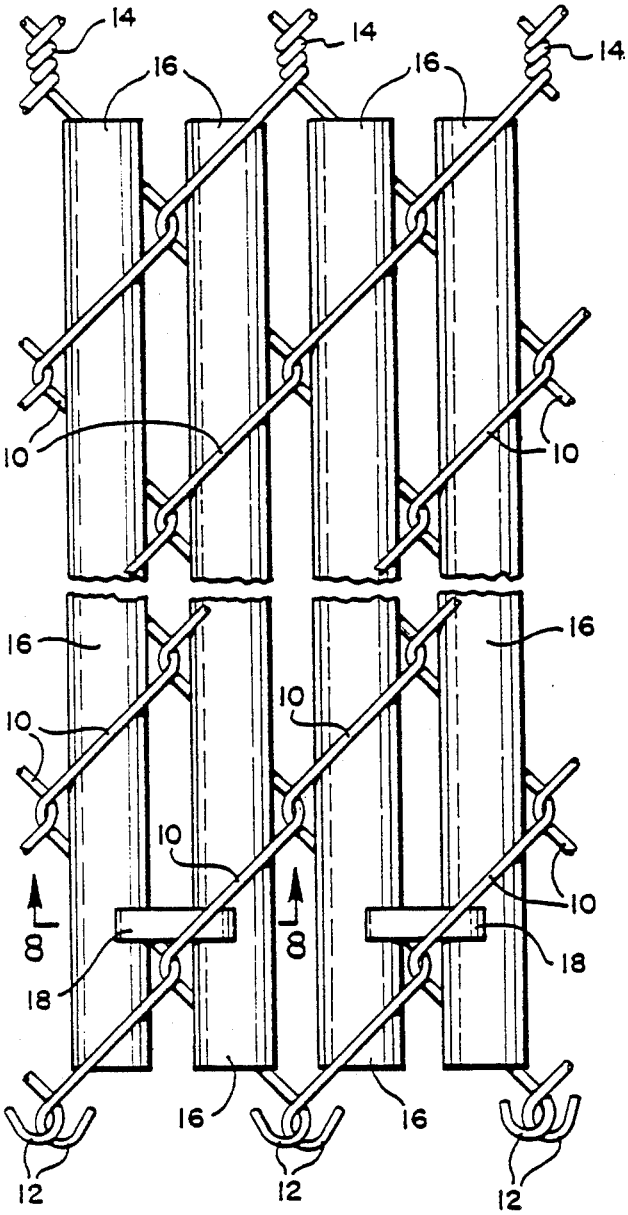
FIG. 7 is a fragmentary view in elevation of a portion of chain link fencing incorporating the novel clip members and a second preferred embodiment of slats in accordance with the invention.
Figure 8:
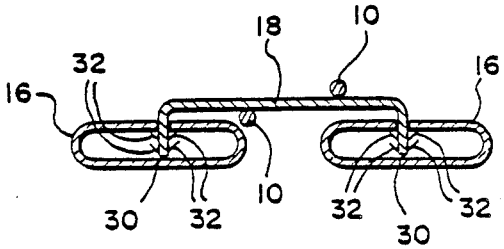
FIG. 8 is a cross section taken along line 8—8 of FIG. 7 showing the novel connection between the slats of the second preferred embodiment of this invention.
Figure 9:
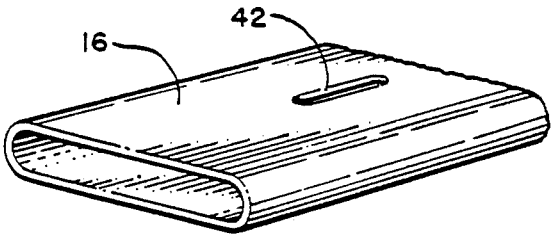
FIG. 9 is a fragmentary end pictorial view of the second preferred embodiment of a slat as shown in FIGS. 7 and 8.

A second preferred embodiment of slats and the novel clip members of this invention is shown in FIGS. 7–9. The slats 16 are of a flattened tubular configuration which is in itself well known and customary. The slats 16 have at least one receptacle 42 at a uniform position. As illustrated, the receptacle 42 is at a uniform distance from the bottom end of the slats 16 as the slats 16 are positioned in the fencing. The receptacles 42 are preferably elongate openings as shown which are capable of receiving the mutually respective legs 30 of the clip members 18 which are described previously. The receptacles 42 are preferably located along the longitudinal center line of the flat face of the slat 16.

As shown in FIGS. 7 and 8, adjacent pairs of slats 16 are attached by the clip members 18. The clip members 18 engage the receptables 42 and hold the adjacent pair of slats 16 at a uniform spaced distance between the slats 16. The clip members 18 engage a link 10 on the fencing such that the slats 16 are also maintained at uniform positions along the fencing. As shown in FIG. 7, the clip members 18 can be positioned so as to lie just above one of the twists in the links of the fencing. The clips 18 could be made to bridge over the twists in the fencing as shown in FIG. 1 also. The clip members 18 further restrain the slats 16 within the fence so as to minimize vandals or thiefs from removing the slats 16 from the fencing.

It is to be understood that the present disclosure, including the detailed description of preferred embodiments, is made by way of example and that various other embodiments are possible without departing from the subject matter coming within the scope of the following claims, which subject matter is regarded as the invention. In particular it is to be understood that the present disclosure in its broadest sense encompasses elongate slats which are held in place in uniform positions along the length of the fencing by clips which interconnect adjacent slats while simultaneously engaging a link in the fence. In a particularly preferred embodiment, the slats may comprise means for allowing the slats to be expanded in their width. The preferred use of accordian folds running longitudinally in the slats have been disclosed. But, it is apparent that other expansion means can be conceived, and such alternative means are fully encompassed by the present invention.

I claim:

1. In chain link fencing of the type including a plurality of elongate slats which are woven flatwise through the links of the chain link fabric of the fencing in spaced, parallel arrangement, an improvement in means for retaining the slats at uniform positions along the fencing, said improvement comprising at least one receptacle formed at a uniform position in each of the elongate slats; and a generally u-shaped clip member comprising two legs extending from the opposite ends of an elongate base, said legs on each clip member engaging mutually respective receptacles in adjacent slats, and said bases on each clip member engaging a link in said fencing such that said clip members maintain the slats at uniform positions along the fencing.

2. The improvement in chain link fencing in accordance with claim 1, wherein said clip members further comprise interlocking means on each of the legs thereof, said interlocking means engaging and interlocking with mutually respective receptacles in said slats.

3. The improvement in chain link fencing in accordance with claim 1, wherein said interlocking means comprise one or more barbs on each leg of said clip members.

4. The improvement in chain link fencing in accordance with claim 2, wherein each said receptacle on said slat comprises an elongate slit which is oriented such that its longitudinal axis is essentially parallel with the longitudinal axis of said slat; and each of said clip members has the form of a short piece of channel such that the legs are essentially parallel rectangular members spaced by a rectangular base member connected between respective ends of the legs, with the width of the legs being such as to fit snugly within the corresponding slits in said slats.

5. The improvement in chain link fencing in accordance with claim 4, wherein said interlocking means comprise one or more barbs on each leg of said clip members.

6. The improvement in chain link fencing in accordance with claim 1, wherein each of said slats comprise opposite elongate essentially flat side edges separated by an elongate main body portion which is adapted to contract and expand in and out in a direction transverse of the longitudinal axis of said slat; and a plurality of receptacles are formed equally spaced along the longitudinal length of each side edge of said slat, whereby said clip members engage mutually respective receptacles in adjacent side edges of said slats so as to hold each of said slats in both uniform position in said fencing as well as in the desired degree of expansion in its transverse direction.

7. The improvement in chain link fencing in accordance with claim 6, wherein the main body portion has the cross sectional shape of an arch.

8. The improvement in chain link fencing in accordance with claim 6, wherein the main body portion has the cross sectional shape of at least one accordian fold.

* * * * *